US006843710B2

(12) United States Patent
Wadephul

(10) Patent No.: US 6,843,710 B2
(45) Date of Patent: Jan. 18, 2005

(54) DEVICE FOR FEEDING BLASTING SHOTS INTO A CENTRIFUGAL WHEEL

(76) Inventor: Jost Wadephul, Ketzendorfer Grund 23, D-21614 Buxtehude (DE)

( * ) Notice: Subject to any disclaimer, the term of this patent is extended or adjusted under 35 U.S.C. 154(b) by 46 days.

(21) Appl. No.: 10/275,308

(22) PCT Filed: Feb. 28, 2002

(86) PCT No.: PCT/EP02/02217

§ 371 (c)(1),
(2), (4) Date: Nov. 1, 2002

(87) PCT Pub. No.: WO02/070204

PCT Pub. Date: Sep. 12, 2002

(65) Prior Publication Data

US 2003/0114090 A1 Jun. 19, 2003

(30) Foreign Application Priority Data

Mar. 5, 2001 (DE) ..... 201 03 842 U

(51) Int. Cl.[7] ..... B24C 7/00
(52) U.S. Cl. ..... 451/95; 451/97
(58) Field of Search ..... 451/91, 95, 96, 451/97, 446

(56) References Cited

U.S. PATENT DOCUMENTS

RE20,538 E * 10/1937 Minich ..... 451/91
2,341,559 A * 2/1944 Keefer ..... 451/95
2,352,588 A * 6/1944 Rosenberger et al. ..... 451/95
4,227,351 A * 10/1980 Jahn ..... 451/97
5,779,524 A * 7/1998 Swain ..... 451/102
6,126,516 A * 10/2000 Barrier et al. ..... 451/38

FOREIGN PATENT DOCUMENTS

| | | |
|---|---|---|
| DE | 25 38 228 | 3/1977 |
| DE | 198 38 733 | 11/1999 |
| GB | 665 832 | 2/1948 |

* cited by examiner

*Primary Examiner*—David B. Thomas
(74) *Attorney, Agent, or Firm*—R W Becker and Associates; R W Becker

(57) ABSTRACT

The invention relates to a device for feeding blasting shots into the central area of a centrifugal wheel (1) in a shot blasting system via a feed pipe (3), whereby a distributing bushing (7) comprising a distributing opening (8) is provided in the central region thereof. An impeller (9) comprising discharge openings (11) rotates in the distributing bushing (7) together with the centrifugal wheel (1), wherein the shots which are to be accelerated enter in an axial direction, the feed pipe (3) for the shots discharges into the impeller (9) and is provided with a ring-shaped tongue (10) which protrudes into the impeller (9) in the region of the distributing opening (8).

4 Claims, 1 Drawing Sheet

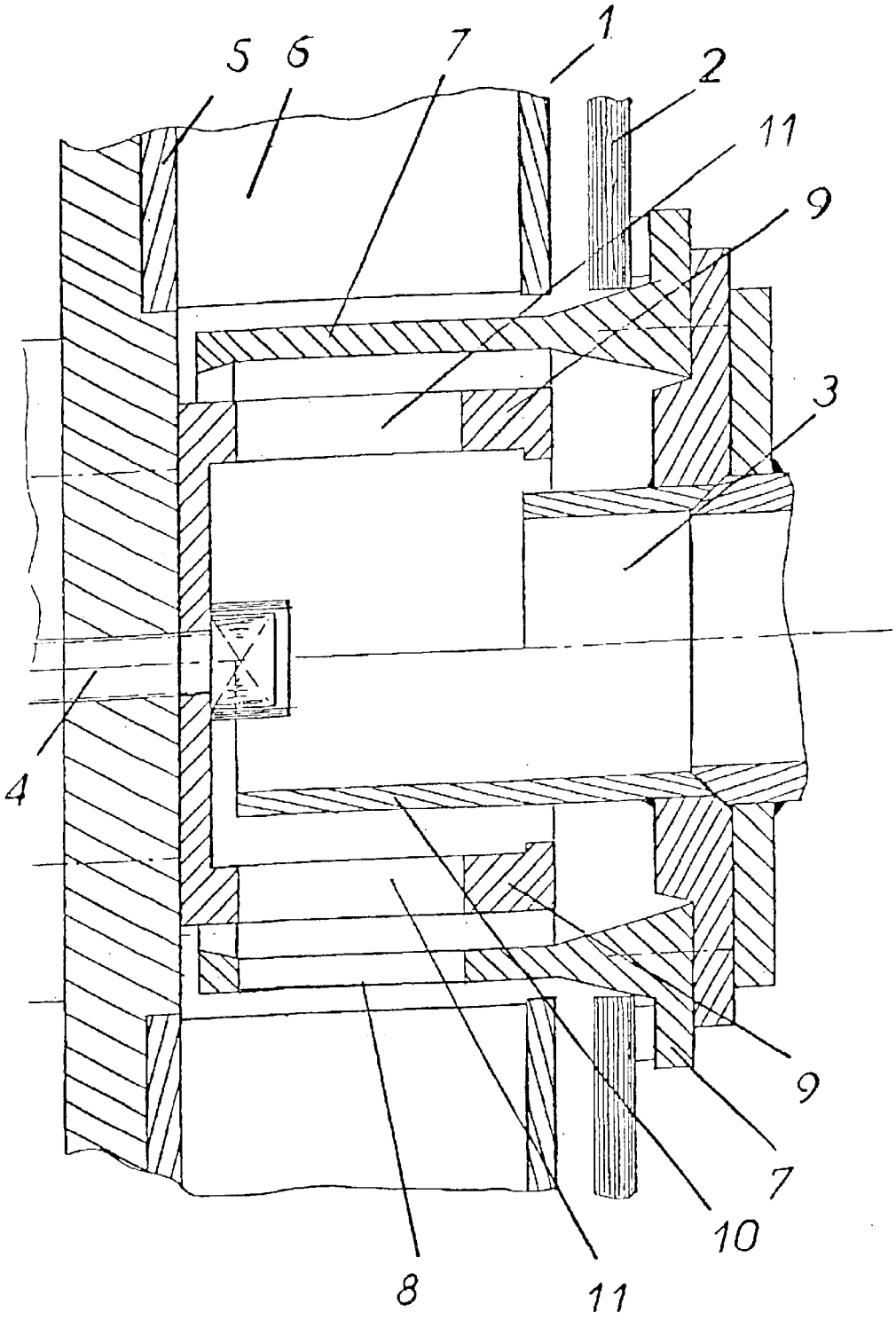
1
2
3
4
5
6
7
8
9
10
11

DEVICE FOR FEEDING BLASTING SHOTS INTO A CENTRIFUGAL WHEEL

The specification incorporates by reference the disclosure of German priority document DE 201 03 842.0 filed Mar. 5, 2001 and International priority document PCT/EP02/02217 filed Feb. 28, 2002.

BACKGROUND OF THE INVENTION

The invention relates to an apparatus for feeding blasting material via a feed line into the central portion of the centrifugal wheel of a blasting unit, whereby in the central portion there is provided a distribution sleeve having a distribution opening, and in the distribution sleeve, together with the centrifugal wheel, an impeller having discharge openings rotates, with the blasting material that is to be accelerated entering the impeller in the axial direction.

With units that are equipped with centrifugal wheels, known, for example, from DE-OS 25 38 228, surfaces of metallic rolled products are freed of scale and/or rust before the surface receives a protective coating, with this being accomplished by flinging or throwing against the surface a blasting material comprised of fine metal particles. In such a centrifugal wheel, not all of the particles of the blasting material move radially and as parallel as possible to the blades as they are discharged outwardly out of the impeller. A significant number of these particles strike against the side panels and the blades, and rebound back from them in a manner similar to a ping pong ball, which not only has a negative effect upon the discharge velocity of the blasting material out of the centrifugal wheel, but also leads to a non-uniform distribution of the blasting material upon the surface that is to be cleaned. Due to the striking of the particles of blasting material against components of the centrifugal wheel, the latter are additionally subject to significant wear.

It is therefore an object of the invention to reduce the wear of the centrifugal wheel caused by the blasting material, and at the same time to produce a blasting pattern having a more uniform coverage over the entire discharge angle of the blasting material out of the centrifugal wheel having nearly parallel side walls.

SUMMARY OF THE INVENTION

This object is inventively realized, proceeding from an apparatus for feeding blasting material of the aforementioned type, in that the feed line for the blasting material opens into the impeller and has a trough-shaped tongue that in the region of the distribution opening extends into the impeller. In this connection, the impeller can be driven with a variable speed and independently of the centrifugal wheel. It is furthermore possible to provide in the center of the impeller a stirring or agitation element that is operatively connected with the drive shaft of the centrifugal wheel.

As a result of the inventive configuration of the opening of the feed line via a trough-shaped tongue that extends into the impeller and that essentially covers or overlaps the region of the distribution opening for the blasting material into the centrifugal wheel, all of the particles of blasting material that are fed in enter the centrifugal wheel from the impeller along a helical path. The tongue that extends into the impeller is, for the blasting material that exits the feed line, a barrier to the direct path to the distribution opening, so that the blasting material cannot pass directly to the distribution opening, but only along a rotational path from the feed line. Consequently, there results a smoother transfer of the blasting material into the blade region of the centrifugal wheel along with a subsequent more uniform acceleration until the material leaves the blades, and striking of the blasting material against the blades and side walls of the centrifugal wheel is essentially avoided. The impact-free transfer of the blasting material from the impeller, which operates as a central accelerator, into the centrifugal wheel ensures a more uniform guidance of the blasting material in the centrifugal wheel, as a result of which not only a more uniform distribution of the blasting material upon the surface that is to be treated is achieved, but also the wear of the centrifugal wheel as well as the energy expended for the acceleration of the blasting material are reduced.

BRIEF DESCRIPTION OF THE DRAWING

An embodiment of the invention will now be described with the aid of the drawing, which shows a schematic cross-sectional view through a centrifugal wheel.

DESCRIPTION OF PREFERRED EMBODIMENTS

The illustrated centrifugal wheel 1 is surrounded by a housing 2 into the central portion of which opens a feed line 3 via which the abrasive material or blasting shots, such as quartz sand or steel shot, is supplied to the centrifugal wheel 1. Opposite the opening of the feed line 3, the drive shaft 4 of the centrifugal wheel 1 projects out of the housing 2.

The centrifugal wheel 1 has a side disk or panel 5 that is secured to the drive shaft 4 and, on that surface opposite the drive shaft 4, carries blades 6, the inner ends of which are adjacent to a distribution sleeve 7 that has a distribution opening 8. Provided within the distribution sleeve 7 is an impeller 9 or central accelerator that is fixedly connected with the drive shaft 4 and the side panel 5; discharge openings 11 are formed in the impeller. The blasting material that exits the feed line 3 passes into the impeller 9 via a trough-shaped tongue 10 that essentially covers or overlaps the region over the distribution opening 8 in the distribution sleeve 7.

The specification incorporates by reference the disclosure of German priority document DE 201 03 842.0 filed Mar. 5, 2001 and International priority document PCT/EP02/02217 filed Feb. 28, 2002.

What is claimed is:

1. An apparatus for feeding blasting material via a feed line into a central portion of a centrifugal wheel of a blasting unit, comprising:

a distribution sleeve disposed in said central portion of said centrifugal wheel, wherein said distribution sleeve is provided with a distribution opening;

an impeller that rotates in said distribution sleeve along with rotation of said centrifugal wheel, wherein said impeller is provided with discharge openings, wherein said feed line opens into said impeller, and wherein blasting material that is to be accelerated enters said impeller in an axial direction; and a trough-shaped tongue provided on said feed line and extending into said impeller in a vicinity of said distribution opening of said distribution sleeve.

2. An apparatus according to claim 1, wherein said trough-shaped tongue covers a large area of the vicinity of said distribution opening within said impeller.

3. An apparatus according to claim 2, wherein said impeller is drivable with a variable speed independently of said centrifugal wheel.

4. An apparatus according to claim 1, wherein a stirring element is provided in a central portion of said impeller, and wherein said stirring element is operatively connected with a drive shaft of said centrifugal wheel.

* * * * *

UNITED STATES PATENT AND TRADEMARK OFFICE

CERTIFICATE OF CORRECTION

PATENT NO. : 6,843,710 B2
DATED : January 18, 2005
INVENTOR(S) : Wadephul

It is certified that error appears in the above-identified patent and that said Letters Patent is hereby corrected as shown below:

Title page, Item [54] and Column 1, line 1,
Title, should read -- APPARATUS FOR FEEDING BLASTING MATERIAL INTO A CENTRIFUGAL WHEEL --

Signed and Sealed this

Twelfth Day of April, 2005

JON W. DUDAS
*Director of the United States Patent and Trademark Office*